US011619229B2

(12) United States Patent
Yamamoto et al.

(10) Patent No.: US 11,619,229 B2
(45) Date of Patent: Apr. 4, 2023

(54) SCROLL COMPRESSOR INCLUDING A FIXED SCROLL HAVING AN OIL SUPPLY HOLE AND A GROOVE DISPOSED AT A POSITION CORRESPONDING TO THE OIL SUPPLY HOLE OR ON AN OUTER SIDE OF THE OIL SUPPLY HOLE

(71) Applicant: KABUSHIKI KAISHA TOYOTA JIDOSHOKKI, Kariya (JP)

(72) Inventors: Shiori Yamamoto, Aichi-ken (JP); Takuro Yamashita, Aichi-ken (JP); Keita Jinno, Aichi-ken (JP); Yuya Hattori, Aichi-ken (JP); Takumi Maeda, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 17/570,722

(22) Filed: Jan. 7, 2022

(65) Prior Publication Data

US 2022/0235771 A1 Jul. 28, 2022

(30) Foreign Application Priority Data

Jan. 27, 2021 (JP) ..... JP2021-011311

(51) Int. Cl.
*F04C 18/02* (2006.01)
*F04C 29/02* (2006.01)
*F04C 29/12* (2006.01)

(52) U.S. Cl.
CPC ..... *F04C 18/0215* (2013.01); *F04C 18/0253* (2013.01); *F04C 29/02* (2013.01); *F04C 29/12* (2013.01); *F04C 2240/30* (2013.01); *F04C 2240/60* (2013.01)

(58) Field of Classification Search
CPC ..... F04C 2/025; F04C 18/0207–0292; F04C 29/02–028
See application file for complete search history.

(56) References Cited

U.S. PATENT DOCUMENTS

2004/0191083 A1* 9/2004 Gennami ..... F04C 23/008 417/310
2009/0169406 A1* 7/2009 Ueno ..... F04C 29/028 418/55.6
2017/0058900 A1* 3/2017 Park ..... F04C 29/12

FOREIGN PATENT DOCUMENTS

JP 3203919 B2 9/2001
JP 2018-031292 A 3/2018
(Continued)

*Primary Examiner* — Laert Dounis
(74) *Attorney, Agent, or Firm* — Sughrue Mion, PLLC

(57) ABSTRACT

A scroll compressor includes: a housing; a rotary shaft; a fixed scroll including a fixed base plate, a fixed spiral wall, and an outer peripheral wall; an orbiting scroll including an orbiting base plate and an orbiting spiral wall; a compression chamber; a suction port; a suction chamber; a discharge chamber; an oil storage chamber; and an oil supply hole. The fixed scroll includes a groove disposed at the same position as the oil supply hole or on an outer side with respect to the oil supply hole in a radial direction of the rotary shaft. At least part of the groove is configured to be closed by the orbiting base plate according to a revolution of the orbiting scroll. The oil supply hole and the groove form part of an oil supply passage that supplies oil in the oil storage chamber to the suction chamber.

4 Claims, 5 Drawing Sheets

(56) References Cited

FOREIGN PATENT DOCUMENTS

| | | | |
|---|---|---|---|
| JP | 2020-139460 | A | 9/2020 |
| JP | 2020-165362 | A | 10/2020 |

* cited by examiner

SCROLL COMPRESSOR INCLUDING A FIXED SCROLL HAVING AN OIL SUPPLY HOLE AND A GROOVE DISPOSED AT A POSITION CORRESPONDING TO THE OIL SUPPLY HOLE OR ON AN OUTER SIDE OF THE OIL SUPPLY HOLE

CROSS-REFERENCE TO RELATED APPLICATION

This application claims priority to Japanese Patent Application No. 2021-011311 filed on Jan. 27, 2021, the entire disclosure of which is incorporated herein by reference.

BACKGROUND ART

The present disclosure relates to a scroll compressor.

The scroll compressor includes a housing, a rotary shaft, a fixed scroll, and an orbiting scroll. The rotary shaft is rotatably supported by the housing. The fixed scroll includes a fixed base plate, a fixed spiral wall, and an outer peripheral wall. The fixed base plate includes a discharge port at the center thereof. The fixed spiral wall extends from the fixed base plate. The outer peripheral wall extends from the fixed base plate and surrounds the fixed spiral wall. The orbiting scroll includes an orbiting base plate and an orbiting spiral wall. The orbiting base plate is opposed to the fixed base plate. The orbiting spiral wall extends from the orbiting base plate and engages with the fixed spiral wall. The orbiting scroll is configured to revolve relative to the fixed scroll as the rotary shaft rotates.

A compression chamber is defined between the fixed spiral wall and the orbiting spiral wall. The outer peripheral wall includes a suction port. The outer peripheral wall also has a suction chamber that is formed inside the outer peripheral wall and communicates with the suction port. The housing includes a discharge chamber communicating with the discharge port. A refrigerant compressed in the compression chamber is discharged into the discharge chamber. The scroll compressor, as disclosed in Japanese Patent Application Publication No. 2020-165362, for example, includes an oil storage chamber that stores an oil separated from the refrigerant discharged into the discharge chamber and an oil supply passage that supplies the oil in the oil storage chamber to the suction chamber.

However, in the above-described scroll compressor, a flow rate of the oil supplied from the oil supply passage is unstable because the flow rate is likely to vary depending on an operating status of a compression device, which may partially cause poor lubrication between the fixed scroll and the orbiting scroll. In particular, in a case where a pair of suction ports is provided interposing the discharge port therebetween and if the oil is unlikely to be supplied uniformly to both of the pair of the suction ports, the poor lubrication is likely to occur. In order to improve lubricity between the fixed scroll and the orbiting scroll as a whole, it is desirable that the oil supplied from the oil supply passage is temporarily stored in an oil storage chamber that communicates with the suction chamber inside the compression device.

The present disclosure has been made in view of the above circumstances and is directed to providing a scroll compressor that improves lubricity between a fixed scroll and an orbiting scroll.

SUMMARY

In accordance with an aspect of the present disclosure, there is provided a scroll compressor that includes a housing, a rotary shaft, a fixed scroll, an orbiting scroll, a compression chamber, a suction port, a suction chamber, a discharge chamber, an oil storage chamber, and an oil supply hole. The rotary shaft is rotatably supported by the housing. The fixed scroll includes a fixed base plate including a discharge port at a center of the fixed base plate, a fixed spiral wall extending from the fixed base plate, and an outer peripheral wall extending from the fixed base plate and surrounding the fixed spiral wall. The orbiting scroll includes an orbiting base plate opposed to the fixed base plate, and an orbiting spiral wall extending from the orbiting based plate and engaging with the fixed spiral wall. The orbiting scroll is configured to revolve relative to the fixed scroll as the rotary shaft rotates. The compression chamber is defined between the fixed spiral wall and the orbiting spiral wall. The suction port is formed in the outer peripheral wall. The suction chamber is formed inside the outer peripheral wall and communicates with the suction port. The discharge chamber is defined inside the housing, communicates with the discharge port. The discharge chamber is a chamber into which a refrigerant compressed in the compression chamber is discharged. The oil storage chamber stores oil separated from the refrigerant discharged into the discharge chamber. The oil supply hole is formed in the fixed scroll. The fixed scroll includes a groove disposed at the same position as the oil supply hole or on an outer side with respect to the oil supply hole in a radial direction of the rotary shaft. At least part of the groove is configured to be closed by the orbiting base plate as the orbiting scroll revolves relative to the fixed scroll. The oil supply hole and the groove form part of an oil supply passage that supplies the oil in the oil storage chamber to the suction chamber.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

An embodiment of a scroll compressor according to the present disclosure will be described with reference to FIGS. 1 to 6. The scroll compressor of the present embodiment is used for, e.g., an air-conditioning system for a vehicle.

Figure 1:
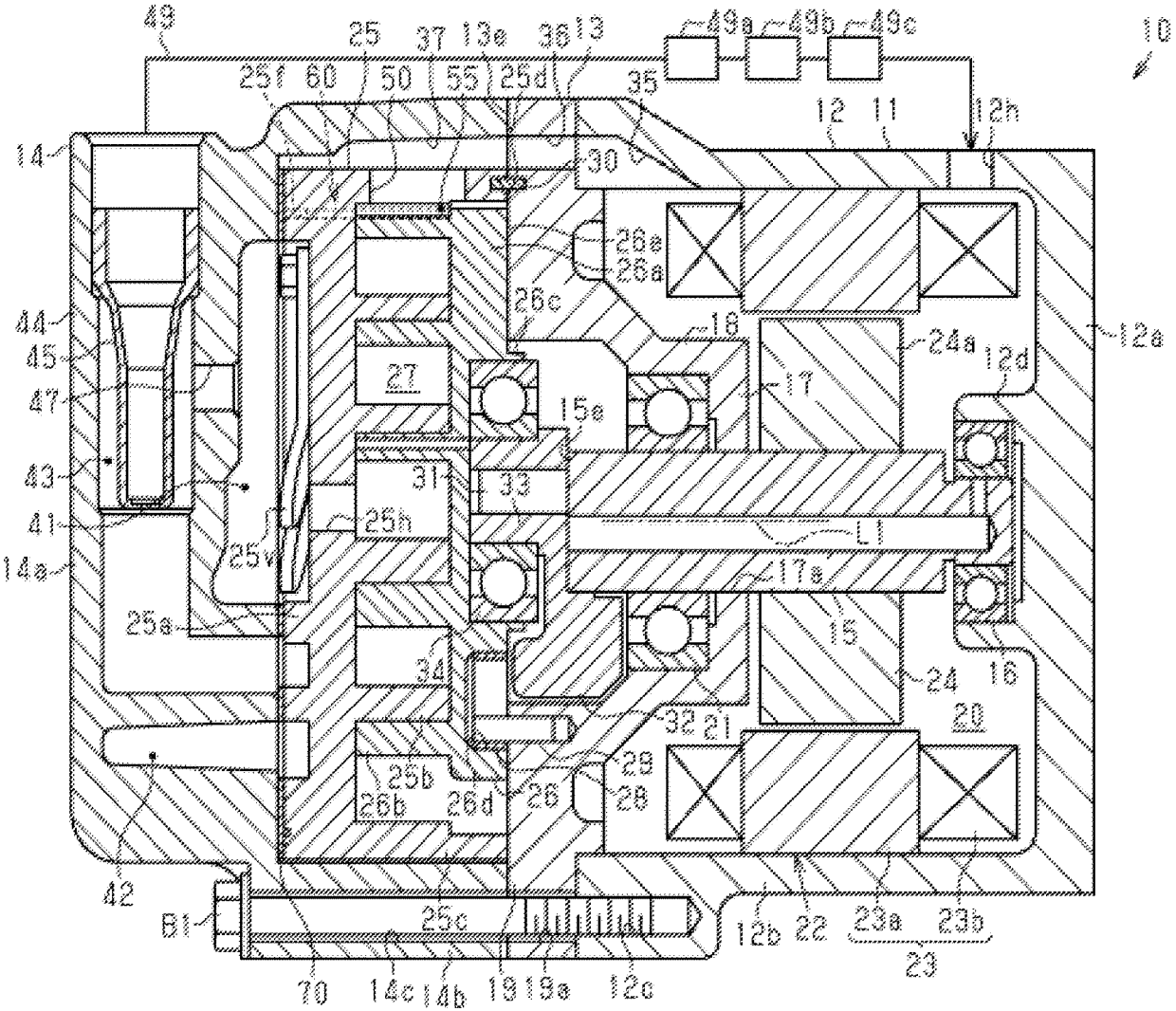
FIG. 1 is a side section view of a scroll compressor according to an embodiment of the present disclosure.

As illustrated in FIG. 1, a scroll compressor 10 includes a housing 11 having a cylindrical shape. The housing 11 includes a motor housing 12, a shaft support housing 13, and a discharge housing 14. The motor housing 12, the shaft support housing 13, and the discharge housing 14 are made of metal, e.g., aluminum. The scroll compressor 10 includes a rotary shaft 15 accommodated inside the housing 11.

The motor housing 12 has a bottomed cylindrical shape and includes a disc-shaped end wall 12*a* and a peripheral wall 12*b* that cylindrically extends from an outer peripheral edge of the end wall 12*a*. An axial direction of the peripheral wall 12*b* coincides with an axial direction of the rotary shaft 15. The peripheral wall 12*b* includes a female screw hole 12*c* at an opening end of the peripheral wall 12*b*. The peripheral wall 12*b* also includes a suction hole 12*h* that takes in a refrigerant gas. The suction hole 12*h* is disposed at a position of the peripheral wall 12*b* close to the end wall 12*a*. The suction hole 12*h* provides communication between an inside and an outside of the motor housing 12.

The end wall 12*a* includes a boss 12*d* having a cylindrical shape and protruding from an inner surface of the end wall 12*a*. A first end of the rotary shaft 15, i.e., one of ends of the rotary shaft 15 in the axial direction, is inserted inside the boss 12*d*. A rolling bearing 16 is interposed between an inner peripheral surface of the boss 12*d* and an outer peripheral surface of the first end of the rotary shaft 15. The first end of the rotary shaft 15 is rotatably supported by the motor housing 12 via the rolling bearing 16.

The shaft support housing 13 has a bottomed cylindrical shape and includes an end wall 17 having a disc shape and a peripheral wall 18 that extends from an outer peripheral portion of the end wall 17. An axial direction of the peripheral wall 18 coincides with the axial direction of the rotary shaft 15. The shaft support housing 13 includes a flange wall 19 that has an annular shape and extends, in a radially outward direction of the rotary shaft 15, from an end of an outer peripheral surface of the peripheral wall 18 opposite to the end wall 17. An outer peripheral portion of the flange wall 19 is in contact with the opening end of the peripheral wall 12*b* of the motor housing 12. The outer peripheral portion of the flange wall 19 includes a bolt insertion hole 19*a*. The bolt insertion hole 19*a* is formed through the flange wall 19 in a thickness direction of the flange wall 19. The bolt insertion hole 19*a* of the flange wall 19 communicates with the female screw hole 12*c* of the motor housing 12. The motor housing 12 and the shaft support housing 13 define a motor chamber 20 inside the housing 11. The refrigerant gas is taken into the motor chamber 20 through the suction hole 12*h*.

The end wall 17 includes an insertion hole 17*a* having a circular hole shape at a center portion thereof. The insertion hole 17*a* is formed through the end wall 17 in a thickness direction of the end wall 17. The rotary shaft 15 is inserted through the insertion hole 17*a*. An end surface 15*e* of a second end of the rotary shaft 15, i.e., the other of the ends of the rotary shaft 15 in the axial direction, is disposed inside the peripheral wall 18. A rolling bearing 21 is interposed between an inner peripheral surface of the peripheral wall 18 and an outer peripheral surface of the rotary shaft 15. The rotary shaft 15 is rotatably supported by the shaft support housing 13 via the rolling bearing 21. The rotary shaft 15 is thus rotatably supported by the housing 11.

The motor chamber 20 accommodates an electric motor 22. The electric motor 22 includes a stator 23 having a cylindrical shape and a rotor 24 disposed inside the stator 23. The rotor 24 rotates integrally with the rotary shaft 15. The stator 23 surrounds the rotor 24. The rotor 24 includes a rotor core 24*a* fixedly attached to the rotary shaft 15, and a plurality of permanent magnets (not illustrated) provided in the rotor core 24*a*. The stator 23 includes a stator core 23*a* having a cylindrical shape and fixed to an inner peripheral surface of the peripheral wall 12*b* of the motor housing 12, and a coil 23*b* wound around the stator core 23*a*. By supplying power controlled by a driving circuit (not illustrated) to the coil 23*b*, the rotor 24 rotates and the rotary shaft 15 rotates integrally with the rotor 24.

The discharge housing 14 includes an end wall 14*a* having a disc shape and a peripheral wall 14*b* that cylindrically extends from an outer peripheral edge of the end wall 14*a*. An axial direction of the peripheral wall 14*b* coincides with the axial direction of the rotary shaft 15. An opening end of the peripheral wall 14*b* is in contact with the outer peripheral portion of the flange wall 19. The peripheral wall 14*b* includes a bolt insertion hole 14*c* that communicates with the bolt insertion hole 19*a* of the flange wall 19.

In a state where the outer peripheral portion of the flange wall 19 is in contact with the opening end of the peripheral wall 12*b* of the motor housing 12 and the opening end of the peripheral wall 14*b* of the discharge housing 14 is in contact with the outer peripheral portion of the flange wall 19, a bolt B1 passing through the bolt insertion hole 14*c* and the bolt insertion hole 19*a* is screwed into the female screw hole 12*c* of the motor housing 12. This enables the shaft support housing 13 to be coupled to the peripheral wall 12*b* of the motor housing 12 and the discharge housing 14 to be coupled to the flange wall 19 of the shaft support housing 13. The motor housing 12, the shaft support housing 13, and the discharge housing 14 are aligned in this order in the axial direction of the rotary shaft 15.

The scroll compressor 10 includes a fixed scroll 25 and an orbiting scroll 26. The fixed scroll 25 and the orbiting scroll 26 are disposed inside the peripheral wall 14*b* of the discharge housing 14. The fixed scroll 25 is located closer to the end wall 14*a* than the orbiting scroll 26 is, in the axial direction of the rotary shaft 15.

Figure 2:
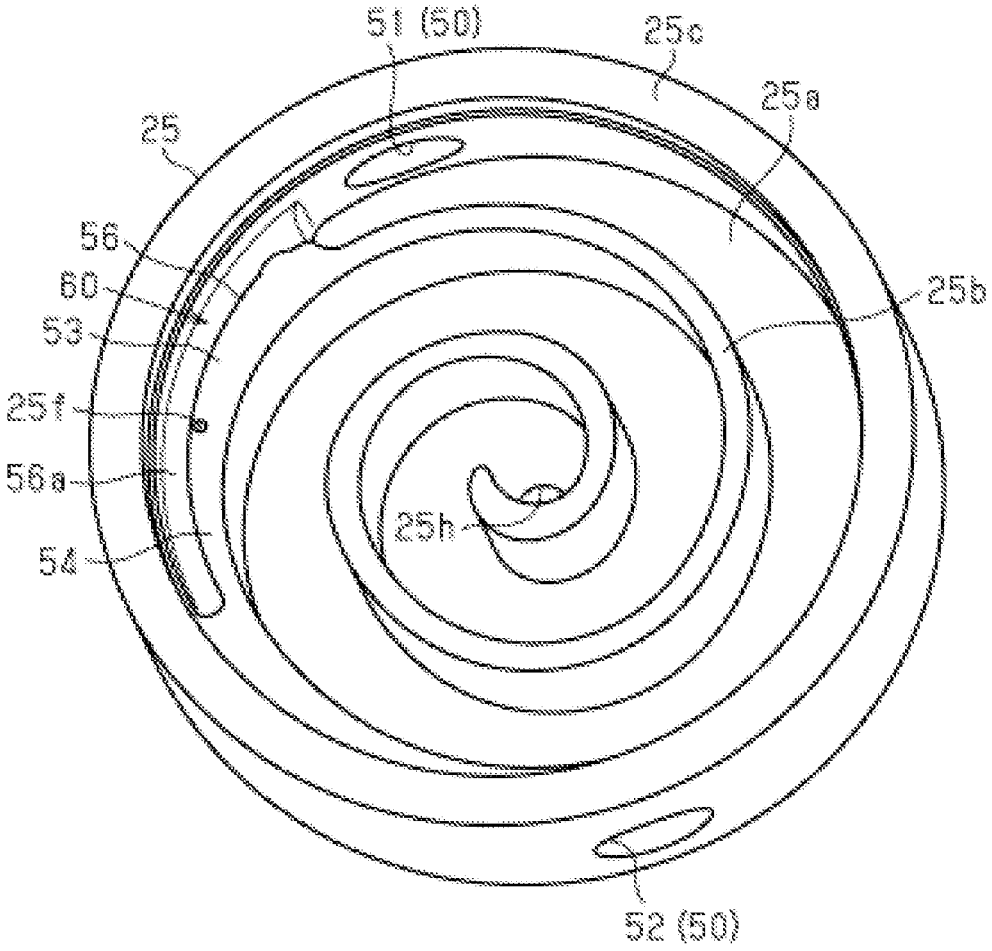
FIG. 2 is a perspective view of a fixed scroll.

As illustrated in FIGS. 1 and 2, the fixed scroll 25 includes a fixed base plate 25*a*, a fixed spiral wall 25*b*, and a fixed outer peripheral wall 25*c* serving as an outer peripheral wall. The fixed base plate 25*a* has a disc shape. The fixed base plate 25*a* includes a discharge port 25*h* at the center thereof. The discharge port 25*h* has a shape of a circular hole. The discharge port 25*h* is formed through the fixed base plate 25*a* in a thickness direction of the fixed base plate 25*a*. The fixed spiral wall 25*b* extends from the fixed base plate 25*a* in a direction away from the end wall 14*a*. The fixed outer peripheral wall 25*c* cylindrically extends from an outer peripheral portion of the fixed base plate 25*a*. The fixed outer peripheral wall 25*c* surrounds the fixed spiral wall 25*b*. An opening end surface of the fixed outer peripheral wall 25*c* is disposed on a side of the fixed outer peripheral wall 25*c* opposite to the fixed base plate 25*a* with respect to a tip end surface of the fixed spiral wall 25*b*.

As illustrated in FIG. 1, the orbiting scroll 26 includes an orbiting base plate 26*a* and an orbiting spiral wall 26*b*. The orbiting base plate 26*a* has a disc shape. The orbiting base plate 26*a* is opposed to the fixed base plate 25*a*. The orbiting spiral wall 26*b* extends from the orbiting base plate 26*a* toward the fixed base plate 25*a*. The orbiting spiral wall 26*b* engages with the fixed spiral wall 25*b*. The orbiting spiral wall 26*b* is disposed inside the fixed outer peripheral wall 25*c*. The tip end surface of the fixed spiral wall 25*b* is in contact with the orbiting base plate 26*a* and a tip end surface of the orbiting spiral wall 26*b* is in contact with the fixed base plate 25*a*. The fixed base plate 25*a*, the fixed spiral wall 25*b*, the orbiting base plate 26*a*, and the orbiting spiral wall 26*b* define a compression chamber 27 in which the refrigerant gas is compressed. Therefore, the scroll compressor 10 includes the compression chamber 27 defined between the fixed spiral wall 25*b* and the orbiting spiral wall 26*b*.

The orbiting base plate 26*a* includes a boss 26*c* having a cylindrical shape and protruding from an end surface 26*e* of the orbiting base plate 26*a* opposite to the fixed base plate 25*a*. An axial direction of the boss 26*c* coincides with the axial direction of the rotary shaft 15. The end surface 26*e* of the orbiting base plate 26*a* includes a plurality of recesses 26*d* each having a circular hole shape around the boss 26*c*. The recesses 26*d* are disposed at predetermined intervals in a circumferential direction of the rotary shaft 15. The recesses 26*d* are fitted with ring members 28 each having an annular shape, respectively. Pins 29 to be inserted into the ring members 28, respectively, protrudes from an end surface 13*e* of the shaft support housing 13 on a side of the shaft support housing 13 close to the discharge housing 14.

A valve member 25*v* is installed to a surface of the fixed base plate 25*a* on a side of the fixed base plate 25*a* opposite to the orbiting scroll 26. The valve member 25*v* is configured to open and close the discharge port 25*h*. The opening end surface of the fixed outer peripheral wall 25*c* includes a plurality of positioning recesses 25*d*. Positioning pins 30 to be inserted in the positioning recesses 25*d* protrude, respectively, from the end surface 13*e* of the shaft support housing 13. By the positioning pins 30 being inserted in the respective positioning recesses 25*d*, the fixed scroll 25 is positioned with respect to the shaft support housing 13 in a state where a rotation of the rotary shaft 15 around an axial line L1 inside the peripheral wall 14*b* of the discharge housing 14 is restricted. The end surface 13*e* of the shaft support housing 13 and the opening end surface of the fixed outer peripheral wall 25*c* securely interpose an elastic plate having an annular and plate shape (not illustrated) therebetween. The elastic plate continuously presses the orbiting scroll 26 toward the fixed scroll 25. The fixed scroll 25 is disposed inside the peripheral wall 14*b* of the discharge housing 14 in a state where the fixed scroll 25 is interposed between the end surface 13*e* of the shaft support housing 13 and the end wall 14*a* of the discharge housing 14 so that a movement of the rotary shaft 15 in the axial direction inside the peripheral wall 14*b* of the discharge housing 14 is restricted.

An eccentric shaft 31 protruding from the end surface 15*e* of the rotary shaft 15 toward the orbiting scroll 26, at a position decentered from the axial line L1 of the rotary shaft 15, is integrally formed with the rotary shaft 15. An axial direction of the eccentric shaft 31 coincides with the axial direction of the rotary shaft 15. The eccentric shaft 31 is inserted inside the boss 26*c*. A bush 33 integrated with a balancing weight 32 is fitted to an outer peripheral surface of the eccentric shaft 31. The balancing weight 32 is integrally formed with the bush 33. The balancing weight 32 is accommodated inside the peripheral wall 18 of the shaft support housing 13. The orbiting scroll 26 is supported by the eccentric shaft 31 so as to be relatively rotatable to the eccentric shaft 31 via the bush 33 and a rolling bearing 34.

The rotation of the rotary shaft 15 is transmitted to the orbiting scroll 26 via the eccentric shaft 31, the bush 33, and the rolling bearing 34, which causes the orbiting scroll 26 to rotate on its axis. However, the pins 29 contacting inner peripheral surfaces of the respective ring members 28 stop the orbiting scroll 26 from rotating on its axis and thus only allows the orbiting scroll 26 to revolve. The orbiting scroll 26 revolves with the orbiting spiral wall 26*b* contacting the fixed spiral wall 25*b* so that a volumetric capacity of the compression chamber 27 reduces to compress the refrigerant gas. Therefore, the orbiting scroll 26 revolves according to the rotation of the rotary shaft 15. The balancing weight 32 reduces an unbalanced state of the orbiting scroll 26 by offsetting a centrifugal force acting upon the orbiting scroll 26 when the orbiting scroll 26 revolves.

The peripheral wall 12*b* of the motor housing 12 includes a plurality of first grooves 35 on part of the inner peripheral surface of the peripheral wall 12*b*. Each of the first grooves 35 is open at the opening end of the peripheral wall 12*b*. The outer peripheral portion of the flange wall 19 of the shaft support housing 13 includes first holes 36. The first holes 36 communicate with the first grooves 35, respectively. Each of the first holes 36 is formed through the flange wall 19 in the thickness direction. The peripheral wall 14*b* of the discharge housing 14 includes second grooves 37 on part of an inner peripheral surface of the peripheral wall 14*b*. The second grooves 37 communicate with the first holes 36, respectively. The first grooves 35, the first holes 36, and the second grooves 37 are illustrated only by one each in FIG. 1 for convenience of illustration.

As illustrated in FIGS. 1 and 2, the fixed outer peripheral wall 25*c* of the fixed scroll 25 includes suction ports 50 that communicate with the second grooves 37, respectively. The scroll compressor 10 of the present disclosure includes the suction ports 50 that form a pair. The pair of suction ports 50 interposes the discharge port 25*h*. Each of the suction ports 50 is formed through the fixed outer peripheral wall 25*c* in a thickness direction.

Figure 3:
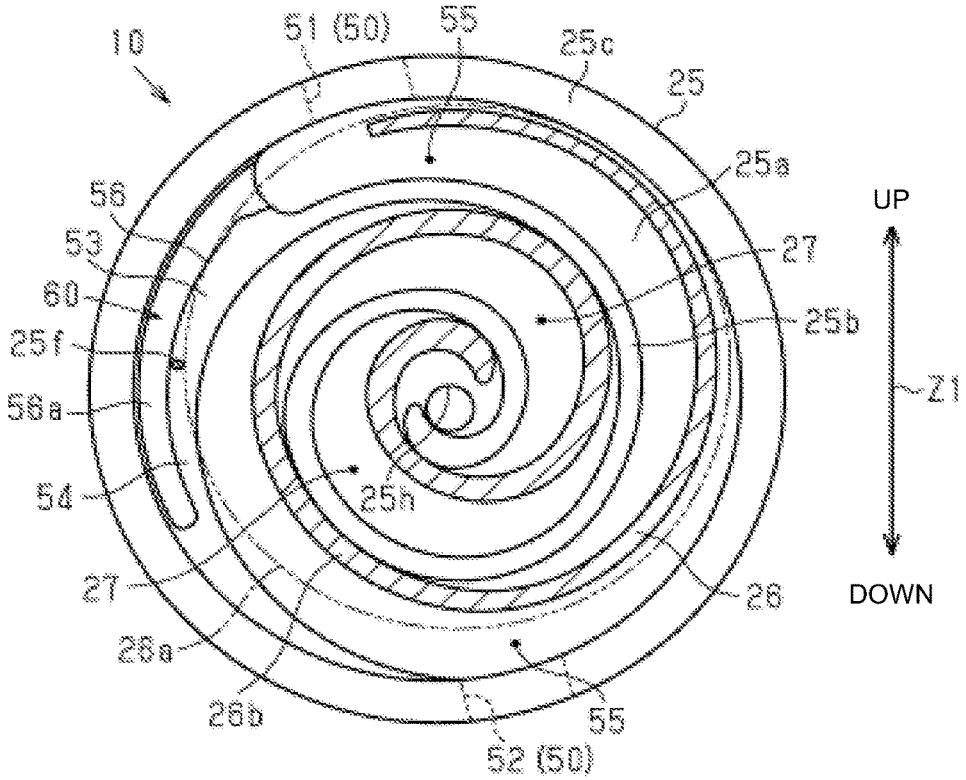
FIG. 3 is a section view of the fixed scroll and an orbiting scroll.
Figure 4:
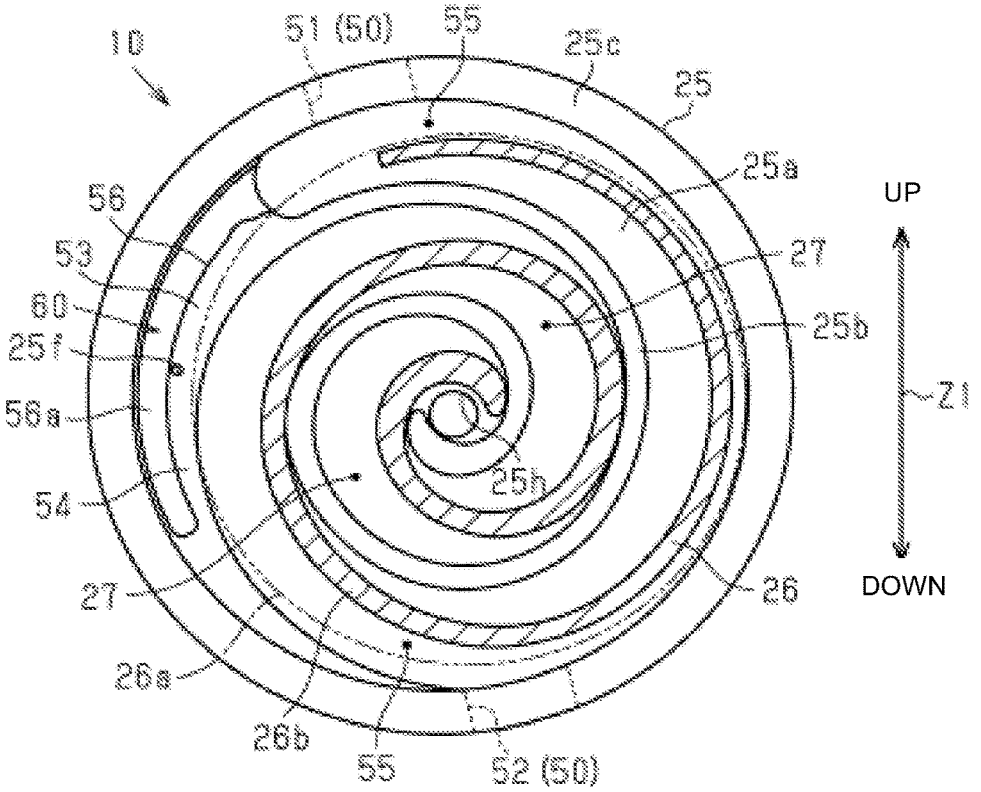
FIG. 4 is another section view of the fixed scroll and the orbiting scroll.
Figure 5:
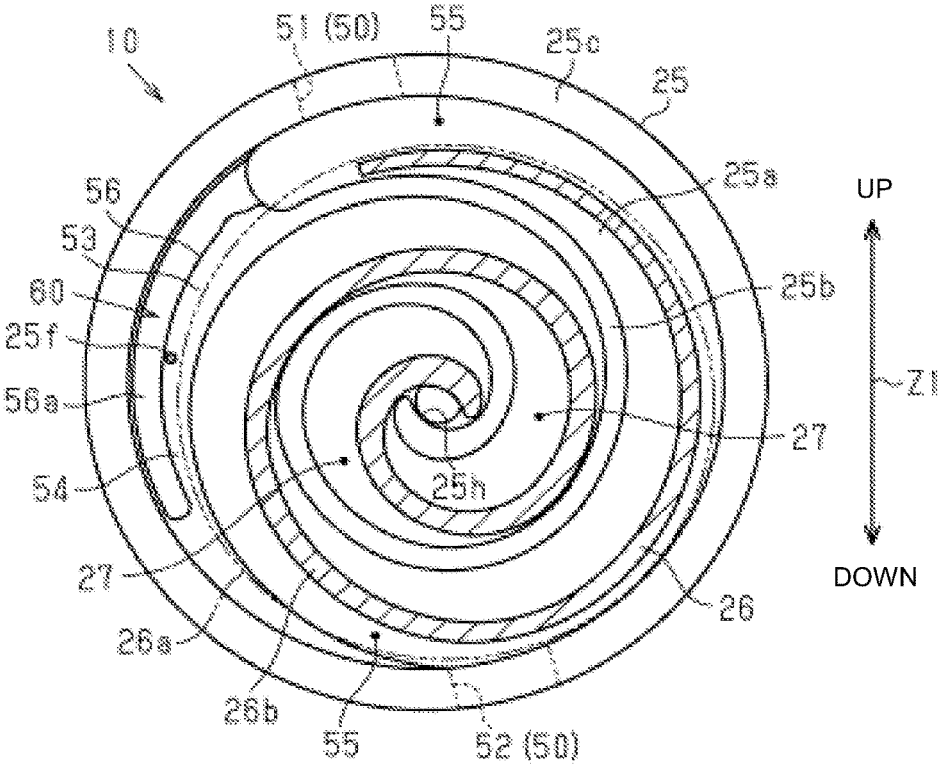
FIG. 5 is still another section view of the fixed scroll and the orbiting scroll.

As illustrated in FIG. 3, one of the pair of suction ports 50 is a first suction port 51 disposed on an upper side of the discharge port 25*h* in a direction of gravity. The direction of gravity is indicated by an arrow Z1 in FIGS. 3 to 7. The other of the pair of suction ports 50 is a second suction port 52 disposed on a lower side of the discharge port 25*h* in the direction of gravity. The first suction port 51 and the second suction port 52 are disposed at positions opposed to each other in a radial direction of the fixed outer peripheral wall 25*c*. The radial direction of the fixed outer peripheral wall 25*c* coincides with the radial direction of the rotary shaft 15.

As illustrated in FIGS. 2 and 3, the fixed scroll 25 includes a connecting portion 53 that connects the fixed spiral wall 25*b* and the fixed outer peripheral wall 25*c*. The connecting portion 53 extends along an inner peripheral surface of the fixed outer peripheral wall 25*c*. The connecting portion 53 extends from the fixed base plate 25*a*. The connecting portion 53 is continuous with the inner peripheral surface of the fixed outer peripheral wall 25*c*. The connecting portion 53 extends from the second suction port 52 toward the first suction port 51 along the inner peripheral surface of the fixed outer peripheral wall 25*c*. An inner peripheral surface of the connecting portion 53 on a side of the connecting portion 53 opposite to the inner peripheral surface of the fixed outer peripheral wall 25*c* is curved along an arc. The inner peripheral surface of the connecting portion 53 extends along the inner peripheral surface of the fixed outer peripheral wall 25*c*. The connecting portion 53 is continuous with an outermost peripheral portion of the fixed spiral wall 25*b*. An inner peripheral surface of the connecting portion 53 is continuous with an inner peripheral surface of the fixed spiral wall 25*b* located at the outermost peripheral portion of the fixed spiral wall 25*b*.

The connecting portion 53 includes a sliding surface 54 with which the orbiting base plate 26*a* intermittently comes into sliding contact as the orbiting scroll 26 revolves relative to the fixed scroll 25. The sliding surface 54 is an end surface of the connecting portion 53 on a side of the connecting portion 53 opposite to the fixed base plate 25*a*. The sliding surface 54 has a flat surface. The sliding surface 54 is disposed at a position closer to the fixed base plate 25*a* than to the opening end surface of the fixed outer peripheral wall 25*c*. The sliding surface 54 is continuous with the inner peripheral surface of the fixed outer peripheral wall 25*c*. The sliding surface 54 is flush with the tip end surface of the fixed spiral wall 25*b*. The sliding surface 54 is continuous with the tip end surface of the fixed spiral wall 25*b* located at the outermost peripheral portion.

As illustrated in FIGS. 3, 4, 5 and 6, the scroll compressor 10 includes a suction chamber 55 that communicates with the pair of suction ports 50. Thus, the suction chamber 55 communicates with the first suction port 51 and the second suction port 52. The suction chamber 55 is formed inside the fixed outer peripheral wall 25*c*. The suction chamber 55 inside the fixed outer peripheral wall 25*c* is a chamber that communicates with at least one of the first suction port 51 and the second suction port 52 according to the revolution of the orbiting scroll 26. The suction chamber 55 may sometimes be a chamber communicating with the first suction port 51 but not with the second suction port 52, a chamber communicating with the second suction port 52 but not the first suction port 51, or a chamber communicating with both the first suction port 51 and the second suction port 52, depending on the position of the orbiting scroll 26.

As illustrated in FIGS. 2, 3, 4, 5 and 6, the connecting portion 53 includes a groove 56. The groove 56 is formed on the sliding surface 54. The groove 56 communicates with the suction chamber 55. The groove 56 extends from a portion of the connecting portion 53 on a side of the connecting portion 53 close to the first suction port 51 in a circumferential direction of the fixed outer peripheral wall 25*c* toward the second suction port 52 along the fixed outer peripheral wall 25*c*. A bottom surface 56*a* of the groove 56 is a flat surface. The bottom surface 56*a* of the groove 56 is located at a position of the groove 56 closer to the opening end surface of the fixed outer peripheral wall 25*c* than to an end surface of the fixed base plate 25*a* on a side of the fixed base plate 25*a* close to the orbiting spiral wall 26*b*. An end portion of the groove 56 on a side of the groove 56 close to the first suction port 51 is opened to a portion of the connecting portion 53 on a side of the connecting portion 53 close to the first suction port 51 in the circumferential direction of the fixed outer peripheral wall 25*c*. Thus, the groove 56 communicates with a portion of the suction chamber 55 on a side of the suction chamber 55 closer to the first suction port 51 than to the second suction port 52.

The end portion of the groove 56 on a side of the groove 56 close to the second suction port 52 is not opened to a portion of the connecting portion 53 on a side of the connecting portion 53 close to the second suction port 52 in the circumferential direction of the fixed outer peripheral wall 25*c*. In other word, the end portion of the groove 56 on the side of the groove 56 close to the second suction port 52 is closed. Part of the sliding surface 54 is interposed, in the circumferential direction of the fixed spiral wall 25*b*, between the groove 56 and the portion of the connecting portion 53 on the side of the connecting portion 53 close to the second suction port 52 in the circumferential direction of the fixed outer peripheral wall 25*c*. Part of the sliding surface 54 is interposed, in the radial direction of the fixed outer peripheral wall 25*c*, between the groove 56 and the fixed spiral wall 25*b*. At least part of the groove 56 is configured to be closed by the orbiting base plate 26*a* as the orbiting scroll 26 revolves relative to the fixed scroll 25.

As illustrated in FIG. 1, the refrigerant gas inside the motor chamber 20 is taken into the suction chamber 55 through the first grooves 35, the first holes 36, the second grooves 37, and the suction ports 50, respectively. The refrigerant gas taken into the suction chamber 55 is compressed in the compression chamber 27 according to the revolution of the orbiting scroll 26.

The scroll compressor 10 includes a discharge chamber 41. The discharge chamber 41 is defined inside the housing 11. The discharge chamber 41 is defined by the discharge housing 14 and the fixed scroll 25. The discharge chamber 41 communicates with the discharge port 25*h*. The refrigerant gas compressed in the compression chamber 27 is discharged through the discharge port 25*h* into the discharge chamber 41.

A gasket 70 having an annular shape is interposed between the discharge housing 14 and the fixed scroll 25. The gasket 70 is a thin plate made of metal. An outer peripheral portion of the gasket 70 extends along the outer peripheral portion of the fixed base plate 25*a*. A gap between the discharge housing 14 and the fixed scroll 25 is sealed by the gasket 70.

The discharge housing 14 includes an oil separating chamber 43. The oil separating chamber 43 is formed inside an external cylinder 44 having an elongated cylindrical shape that is part of the end wall 14*a* of the discharge housing 14. One of end portions of the external cylinder 44 in an axial direction, i.e., a first end portion, is opened to an outer peripheral surface of the end wall 14*a* of the discharge housing 14. The first end portion of the external cylinder 44 and the suction hole 12*h* are connected via an external refrigerant circuit 49. The external refrigerant circuit 49 includes a condenser 49*a*, an expansion valve 49*b*, and an evaporator 49*c*. The scroll compressor 10 and the external refrigerant circuit 49 form an air-conditioning system for a vehicle.

The scroll compressor 10 includes an oil separator 45. The oil separator 45 separates oil from the refrigerant gas that has been discharged into the discharge chamber 41. The oil separator 45 has a cylindrical shape. The oil separator 45 is installed inside the external cylinder 44 by being fitted to an inner peripheral surface of the external cylinder 44 with an axial direction of the oil separator 45 aligned with an axial direction of the external cylinder 44.

The discharge housing 14 includes a guiding hole 47 that provides communication between the discharge chamber 41 and the oil separating chamber 43. The guiding hole 47 guides the refrigerant gas, which has been discharged into the discharge chamber 41, to the oil separating chamber 43. The scroll compressor 10 includes an oil storage chamber 42. The oil storage chamber 42 is disposed at a lower part of the discharge housing 14. The oil storage chamber 42 stores the oil separated from the refrigerant gas by the oil separator 45.

The scroll compressor 10 includes an oil supply passage 60. The oil supply passage 60 includes a communication groove (not illustrated) formed on the outer peripheral portion of the gasket 70 and communicating with the oil storage chamber 42, and an oil supply hole 25*f* communicating with the communication groove. The oil supply hole 25*f* is formed in the fixed scroll 25. A first end of the oil supply hole 25*f* communicates with the communication groove of the gasket 70.

As illustrated in FIG. 2, a second end of the oil supply hole 25*f* is opened to the sliding surface 54. Specifically, the oil supply hole 25*f* is opened to a portion of the sliding surface 54 adjacent to the groove 56 in a radially inner direction of the fixed outer peripheral wall 25*c*. Thus, the fixed scroll 25 includes the groove 56 that is disposed on an outer side with respect to the oil supply hole 25*f* in the radial direction of the rotary shaft 15. The oil supply hole 25*f* is opened between the groove 56 and the fixed spiral wall 25*b*.

As illustrated in FIGS. 3, 4, 5, and 6, the oil supply hole 25*f* is opened and closed by the orbiting base plate 26*a* according to the revolution of the orbiting scroll 26. As specific examples, when the orbiting scroll 26 is at a position illustrated in FIG. 3, 4, or 5 during the revolution, the oil supply hole 25*f* is not closed by the orbiting base plate 26*a*, but is opened. When the orbiting scroll 26 is at a position illustrated in FIG. 6 during the revolution, the oil supply hole 25*f* is closed by the orbiting base plate 26*a*.

The oil supply hole 25*f* and the groove 56 form part of the oil supply passage 60 that supplies the oil in the oil storage chamber 42 to the suction chamber 55. The oil supplied from the oil supply hole 25*f* is temporarily storable in a space formed by the groove 56 and the orbiting base plate 26*a* when at least part of the groove 56 is closed by the orbiting base plate 26*a* according to the revolution of the orbiting scroll 26.

Operational effects of the embodiment of the present disclosure will now be described in the following paragraphs.

The refrigerant gas after compressed in the compression chamber 27 is discharged through the discharge port 25*h* into the discharge chamber 41, and then is guided through the guiding hole 47 into the oil separating chamber 43. The refrigerant gas guided into the oil separating chamber 43 turns around in the oil separator 45. This gives a centrifugal force to the oil included in the refrigerant gas so that the oil is separated from the refrigerant gas in the oil separating chamber 43. The refrigerant gas from which the oil is separated flows into the oil separator 45 through an opening at a lower part of the oil separator 45, passes through the oil separator 45 and the external cylinder 44, and flows out to the external refrigerant circuit 49.

The refrigerant gas having flowed out to the external refrigerant circuit 49 passes through the condenser 49*a*, the expansion valve 49*b*, and the evaporator 49*c* of the external refrigerant circuit 49. The refrigerant gas passing through the condenser 49*a*, the evaporator 49*c*, and the like is a refrigerant gas from which the oil has been separated in the oil separating chamber 43. This reduces a likelihood of the oil attaching to the condenser 49*a*, the evaporator 49*c*, and the like, and thus, reduces deterioration in an efficiency of heat exchange of the condenser 49*a*, the evaporator 49*c*, and the like. The refrigerant gas after having passed the condenser 49*a*, the expansion valve 49*b*, and the evaporator 49*c* returns to the motor chamber 20 through the suction hole 12*h*.

Figure 6:
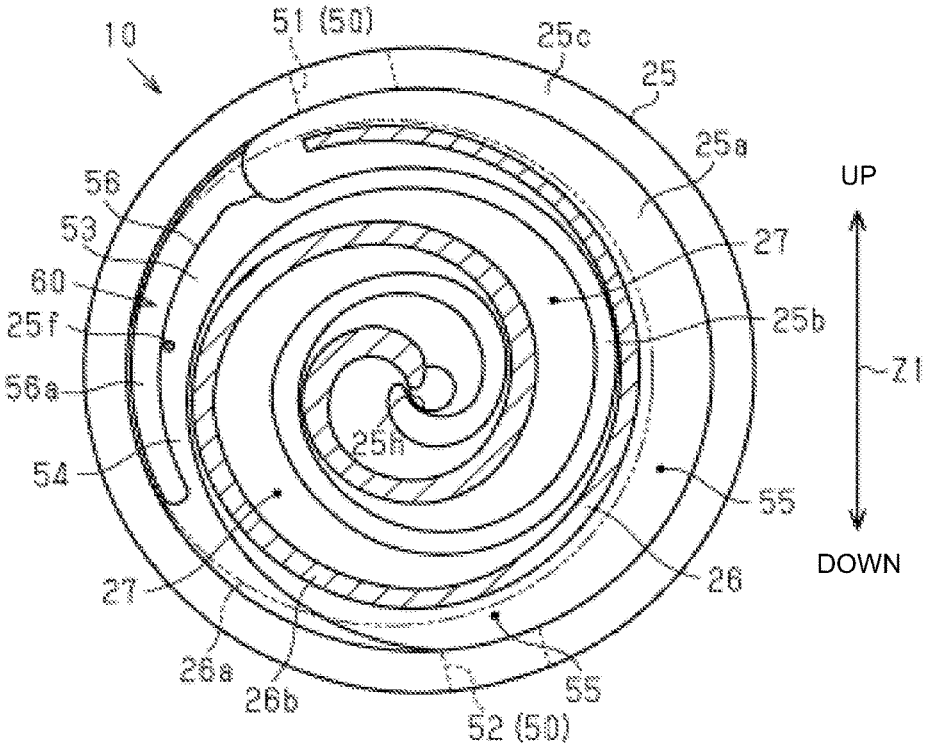
FIG. 6 is yet another section view of the fixed scroll and the orbiting scroll.

The oil separated from the refrigerant gas in the oil separating chamber 43 is stored in the oil storage chamber 42. The oil stored in the oil storage chamber 42 flows through the oil supply hole 25*f*, i.e., the part of the oil supply passage 60, to the sliding surface 54. Some of the oil having flowed out from the oil supply hole 25*f* to the sliding surface 54 flows along the sliding surface 54 to flow into the groove 56. As illustrated in FIG. 6, while the oil supply hole 25*f* is being closed by the orbiting base plate 26*a* according to the revolution of the orbiting scroll 26, the oil having flowed out from the oil supply hole 25*f* toward the sliding surface 54 is pushed out toward the groove 56 and flows along the sliding surface 54 into the groove 56. The oil having flowed into the groove 56 is temporarily stored in the space formed by the groove 56 and the orbiting base plate 26*a*.

The oil having flowed into the groove 56 flows toward a portion of the suction chamber 55, which have an inlet pressure, on a side of the suction chamber 55 closer to the first suction port 51 than to the second suction port 52 because the groove 56 communicates with the portion of the suction chamber 55 on the side of the suction chamber 55 closer to the first suction port 51 than to the second suction port 52. As a result, the oil in the groove 56 flows out from the groove 56 toward the first suction port 51, and flows into the suction chamber 55. Therefore, the oil from the oil supply hole 25*f* flows through the groove 56 toward the first suction port 51 to flow into the suction chamber 55.

Some of the oil having flowed out from the oil supply hole 25*f* to the sliding surface 54 flows along the sliding surface 54 toward the second suction port 52 by own weight and flows into the suction chamber 55 without flowing into the groove 56. Therefore, the oil from the oil supply hole 25*f* flows along the sliding surface 54 toward the second suction port 52 to flow into the suction chamber 55.

As described above, the oil supply passage 60 supplies the oil stored in the oil storage chamber 42 to the suction chamber 55. The oil supplied to the suction chamber 55 is supplied between the fixed scroll 25 and the orbiting scroll 26, which improves lubricity between the fixed scroll 25 and the orbiting scroll 26. This smooths the revolution of the orbiting scroll 26, and improves a compression efficiency of the scroll compressor 10.

The embodiment of the present disclosure has the following advantageous effects.

(1) The oil supplied from the oil supply hole 25*f* is temporarily storable in the space formed by the groove 56 and the orbiting base plate 26*a* to stabilize a flow rate of the oil supplied to the suction chamber 55, which improves lubricity between the fixed scroll 25 and the orbiting scroll 26.

(2) The oil from the oil supply hole 25*f* flows through the groove 56 toward the first suction port 51 to flow into the suction chamber 55, and also flows along the sliding surface 54 toward the second suction port 52 to flow into the suction chamber 55. This reduces a likelihood of partially causing poor lubrication between the fixed scroll 25 and the orbiting scroll 26, which further improves lubricity between the fixed scroll 25 and the orbiting scroll 26.

(3) The oil supply hole 25*f* is opened to the portion of the sliding surface 54 adjacent to the groove 56 in a radially inner direction of the rotary shaft 15. This allows the oil from the oil supply hole 25*f* to flow along the sliding surface 54, and thus allows the oil from the oil supply passage 60 to smoothly flow along the sliding surface 54 toward the second suction port 52 to flow into the suction chamber 55.

(4) The oil supply hole 25*f* is configured to be opened and closed by the orbiting base plate 26*a* according to the revolution of the orbiting scroll 26. While the oil supply hole 25*f* is being closed by the orbiting base plate 26*a* according to the revolution of the orbiting scroll 26, the oil having flowed out from the oil supply hole 25*f* toward the sliding surface 54 is pushed out toward the groove 56. This allows the oil from the oil supply hole 25*f* to smoothly flow through the groove 56 toward the first suction port 51 to flow into the suction chamber 55.

The embodiment according to the present disclosure may be modified as follows. The embodiment described above and modification examples to be described below may be implemented in combination with each other as long as they are not technically inconsistent.

Figure 7:
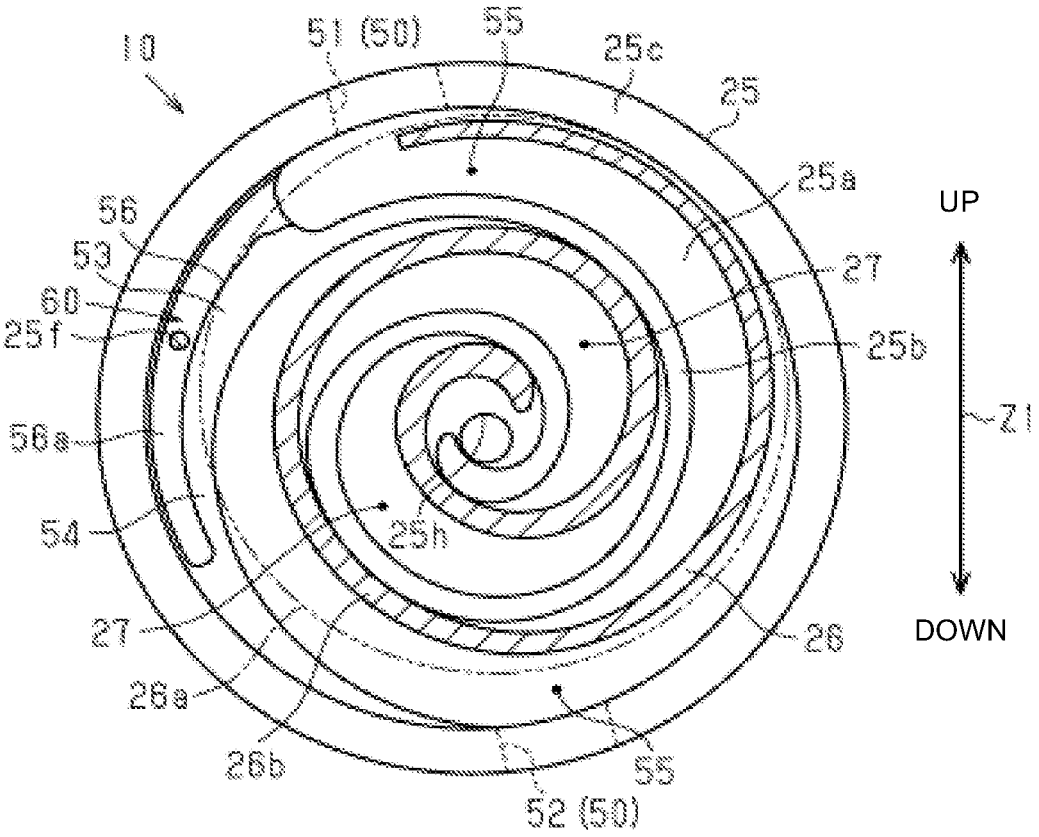
FIG. 7 is a section view of a fixed scroll and an orbiting scroll according to another embodiment of the present disclosure.

As illustrated in FIG. 7, the oil supply hole 25*f* may be opened to the bottom surface 56*a* of the groove 56. The oil supply hole 25*f* is opened to an inside of the groove 56. In this way, the fixed scroll 25 may include the groove 56 disposed at the same position as the oil supply hole 25*f*. Even in this case, the oil supply hole 25*f* and the groove 56 form part of the oil supply passage 60 that supplies the oil in the oil storage chamber 42 to the suction chamber 55. This allows the oil from the oil supply hole 25*f* to flow into the groove 56, and thus allows the oil from the oil supply passage 60 to smoothly flow through the groove 56 toward the first suction port 51 and flow into the suction chamber 55.

The oil supply hole 25*f* of the embodiment illustrated in FIG. 7 is opened to the bottom surface 56*a* of the groove 56, but the opening position of the oil supply hole 25*f* is not limited to the bottom surface 56*a*. For example, the oil supply hole 25*f* may be opened to a side surface, of the groove 56, that forms the groove 56. The oil supply hole 25*f* may be opened at any position with respect to the groove 56 as long as the oil supply hole 25*f* is opened to the inside of the groove 56.

The oil supply hole 25*f* of the embodiment, with respect to the sliding surface 54, need not be opened and closed by the orbiting base plate 26*a* according to the revolution of the orbiting scroll 26, but may be opened to a portion that is continuously open.

The scroll compressor 10 of the embodiment may include another suction port 50 in the fixed outer peripheral wall 25*c* of the fixed scroll 25, in addition to the first suction port 51 and the second suction port 52.

The fixed scroll 25 of the embodiment need not include, for example, the second suction port 52 in the fixed outer peripheral wall 25*c*. The suction port 50 in the fixed outer peripheral wall 25*c* of the fixed scroll 25 may be provided by a single suction port 50.

The scroll compressor 10 of the present embodiment need not be driven by the electric motor 22, but may be driven by, for example, an engine of a vehicle.

What is claimed is:

1. A scroll compressor, comprising:

a housing;

a rotary shaft rotatably supported by the housing;

a fixed scroll including a fixed base plate including a discharge port at a center of the fixed based plate, a fixed spiral wall extending from the fixed base plate, and an outer peripheral wall extending from the fixed base plate and surrounding the fixed spiral wall;

an orbiting scroll including an orbiting base plate opposed to the fixed base plate, and an orbiting spiral wall extending from the orbiting base plate and engaging with the fixed spiral wall, wherein the orbiting scroll is configured to revolve relative to the fixed scroll as the rotary shaft rotates;

a compression chamber defined between the fixed spiral wall and the orbiting spiral wall;

a first suction port and a second suction port formed in the outer peripheral wall and between which the discharge port is interposed, the first suction port being disposed on an upper side of the discharge port in a direction of gravity and the second suction port being disposed on a lower side of the discharge port in the direction of gravity;

a suction chamber formed inside the outer peripheral wall and communicating with the first suction port and the second suction port;

a discharge chamber defined inside the housing and communicating with the discharge port, the discharge chamber into which a refrigerant compressed in the compression chamber is discharged;

an oil storage chamber storing oil separated from the refrigerant discharged into the discharge chamber; and an oil supply hole formed in the fixed scroll, wherein the fixed scroll includes a groove disposed at the same position as the oil supply hole or on an outer side with respect to the oil supply hole in a radial direction of the rotary shaft, at least part of the groove is configured to be closed by the orbiting base plate as the orbiting scroll revolves relative to the fixed scroll, and the oil supply hole and the groove form part of an oil supply passage that supplies the oil in the oil storage chamber to the suction chamber, the fixed scroll includes a connecting portion connecting the fixed spiral wall and the outer peripheral wall, the connecting portion includes a sliding surface with which the orbiting base plate intermittently comes into sliding contact as the orbiting scroll revolves relative to the fixed scroll, the groove is formed on the sliding surface and communicates with the suction chamber, and the oil from the oil supply hole flows toward the first suction port into the suction chamber, and flows along the sliding surface toward the second suction port into the suction chamber.

2. The scroll compressor according to claim 1, wherein the oil supply hole is opened to a portion of the sliding surface adjacent to the groove in a radially inner direction of the rotary shaft.

3. The scroll compressor according to claim 2, wherein the oil supply hole is configured to be opened and closed by the orbiting base plate as the orbiting scroll revolves relative to the fixed scroll.

4. The scroll compressor according to claim 1, wherein the oil supply hole is opened to a bottom surface of the groove.

* * * * *